US005429845A

United States Patent [19]

Newhouse et al.

[11] Patent Number: 5,429,845

[45] Date of Patent: Jul. 4, 1995

[54] BOSS FOR A FILAMENT WOUND PRESSURE VESSEL

[75] Inventors: Norman L. Newhouse; Ronald B. Veys; Dale B. Tiller, all of Lincoln, Nebr.

[73] Assignee: Brunswick Corporation, Lake Forest, Ill.

[21] Appl. No.: 255,115

[22] Filed: Jun. 7, 1994

Related U.S. Application Data

[63] Continuation of Ser. No. 161,199, Dec. 2, 1993, abandoned, which is a continuation-in-part of Ser. No. 902,725, Jun. 23, 1992, abandoned, which is a continuation-in-part of Ser. No. 818,619, Jan. 10, 1992, abandoned.

[51] Int. Cl.[6] ..... F17C 1/00

[52] U.S. Cl. ..... 428/34.1; 220/414; 220/581; 220/415; 220/582; 220/465; 220/589; 220/435; 428/35.7; 138/30; 403/24

[58] Field of Search ..... 428/34.1, 35.7, 545, 428/99, 121, 124, 131, 192; 220/581, 582, 589, 414, 415, 465, 435, DIG. 17; 138/30; 403/24

[56] References Cited

U.S. PATENT DOCUMENTS 3,195,758 5/1967 Mercier ..... 138/30
3,319,658 6/1969 Mercier ..... 138/30
3,907,149 9/1975 Harmon et al. ..... 220/3
4,360,116 11/1982 Humphrey ..... 220/3

FOREIGN PATENT DOCUMENTS 2193953 6/1972 France .
2152123 5/1973 Germany .

*Primary Examiner*—Charles R. Nold
*Attorney, Agent, or Firm*—John R. Hoffman

[57] ABSTRACT

A boss is disposed in a polar opening in a pressure vessel which has a filament wound outer shell and a non-metallic internal liner. The boss has a tubular neck which projects outwardly from the vessel interior and an annular support flange which extends radially from the internal end of the neck and supports the perimeter of the polar opening. An offset attachment flange extends radially from the support flange and has two axially opposed surfaces with locking grooves formed therein. Each locking groove has a bottom wall intermediate a pair of mutually skewed sidewalls for maintaining positive engagement with and retention of complementary respective tabs on the liner. In an application where the liner is a blow molded component, an injection molded interface member is attached to the support flange and provides a site at which the liner is welded.

23 Claims, 2 Drawing Sheets

BOSS FOR A FILAMENT WOUND PRESSURE VESSEL

This application is a continuation of application Ser. No. 08/161,199, filed Dec. 2, 1993, now abandoned, which is a file wrapper continuation of Ser. No. 07/902,725, filed Jun. 23, 1992, now abandoned which is a continuation-in-part of Ser. No. 07/818,619, filed Jan. 10, 1992, now abandoned.

BACKGROUND OF THE INVENTION

1. Technical Field

The present invention is an improved boss for reinforcing the structural interface between a filament wound outer shell and a non-metallic internal liner in a rounded high pressure vessel.

2. Background Art

In many circumstances, the qualities of lightweight construction and high resistance to fragmentation and corrosion damage are highly desirable characteristics for a pressure vessel. These design criteria have been met for many years by the development of high pressure composite containers fabricated of laminated layers of wound fiberglass filaments or various types of synthetic filaments which are bonded together by a thermal-setting epoxy resin. An elastomeric or other non-metal resilient liner or bladder is suspended within the filament wound shell to seal the vessel and prevent internal fluids from contacting the composite material.

Filament wound vessels often are constructed in a spherical shape or a cylindrical shape with generally spherical ends for use in high pressure applications. A boss is used to reliably join the internal liner with the outer composite shell at pressurization ports in the outer shell such that fluid is prevented from penetrating between the liner and the shell. In many applications, such as in the aerospace industry, composite pressure vessels are required to contain extremely high pressures, operating at 25,000 p.s.i. with design burst values in the range of 50,000 p.s.i. Consequently, as internal pressure increases, the interface of the boss, the liner and the outer shell is subjected to extreme structural loading.

More particularly, as pressure within the vessel is increased, bearing stress is generated between the boss and the composite shell, resulting in a steep strain gradient through the shell, with the inner strains being much higher than those at the outer surface. Shearing stress develops between the boss and the internal liner due to relative displacement discontinuities resulting from nonuniform loading during internal pressurization. In addition, radially extending support members on the boss are subjected to unacceptable levels of bending stress which can result in fracture of the boss.

Moreover, it is critical that during the pressurization of the vessel the liner and outer shell remain firmly engaged with the boss, despite the adverse loading to which the liner and shell are subjected. The present invention is directed toward overcoming the above mentioned loading and sealing problems by providing a unique construction in a boss for a filament wound pressure vessel of the character described.

SUMMARY OF THE INVENTION

It is an object of the present invention, therefore, to provide a new and improved boss for reinforcing the structural interface between a filament wound reinforcement shell and a non-metallic internal liner in a rounded section of a high pressure vessel.

In the exemplary embodiment of one form of the invention, a boss is disposed in an opening in a spherical section of a pressure vessel which has a filament wound outer shell and a non-metallic internal liner. The boss has a tubular neck which projects outwardly from the vessel interior and an annular support flange which extends radially from the internal end of the neck and supports the perimeter of the interface of the shell and liner about the opening. An offset attachment flange extends radially from the support flange and has an annular locking groove engaged with a complementary tab on the liner.

In the disclosed embodiment of the invention, locking grooves are provided on each of two axially opposite offset surfaces of the attachment flange. The locking groove in the outer surface of the attachment flange opens outwardly and the locking groove in the inner surface of the attachment flange opens inwardly, with each of the locking grooves having a bottom wall intermediate a pair of mutually skewed sidewalls for maintaining positive engagement with the liner. The offset characteristic of the attachment flange reduces the risk that the liner will extrude out of engagement with the boss and cause leakage between the outer shell and the liner.

In order to reduce shear stress between the boss and the liner during internal pressurization of the vessel, a non-metallic shear stress relieving layer is interposed between the outer surface of the annular flange and the inner surface of the outer shell. The interposed layer may be made of any plastic, elastomeric, or other non-metallic material, and may be manufactured by a molding process or cut from sheet stock.

Pressurization damage is also reduced by the unique construction of the boss. In a preferred form, the support flange has a diameter sufficient to prevent damage to the outer shell when the vessel is pressurized and is sufficiently thick to avoid unacceptable levels of bending stress in the support flange and attachment flange. The boss may be made from alloys of aluminum, steel, nickel, titanium, or other metals.

In another form of the invention, the liner is made of blow molded high density polyethylene, or HDPE. An axisymmetric interface member is secured to the boss adjacent the pressurization port to provide a site for attaching the liner. The interface member preferably is made of injection molded HDPE which, when solidified, shrinks into conformity with the boss and is thereby securely molded to the boss. The liner is bonded, as by plastic molding, directly to the interface member. A threaded retainer nut is advanced through the neck of the boss to lock the interface member in place.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and advantages, may be understood from the following description taken in conjunction with the accompanying drawings, in which like reference numerals identify like elements in the figures and in which:

DESCRIPTION OF THE PREFERRED EMBODIMENT

Figure 1:
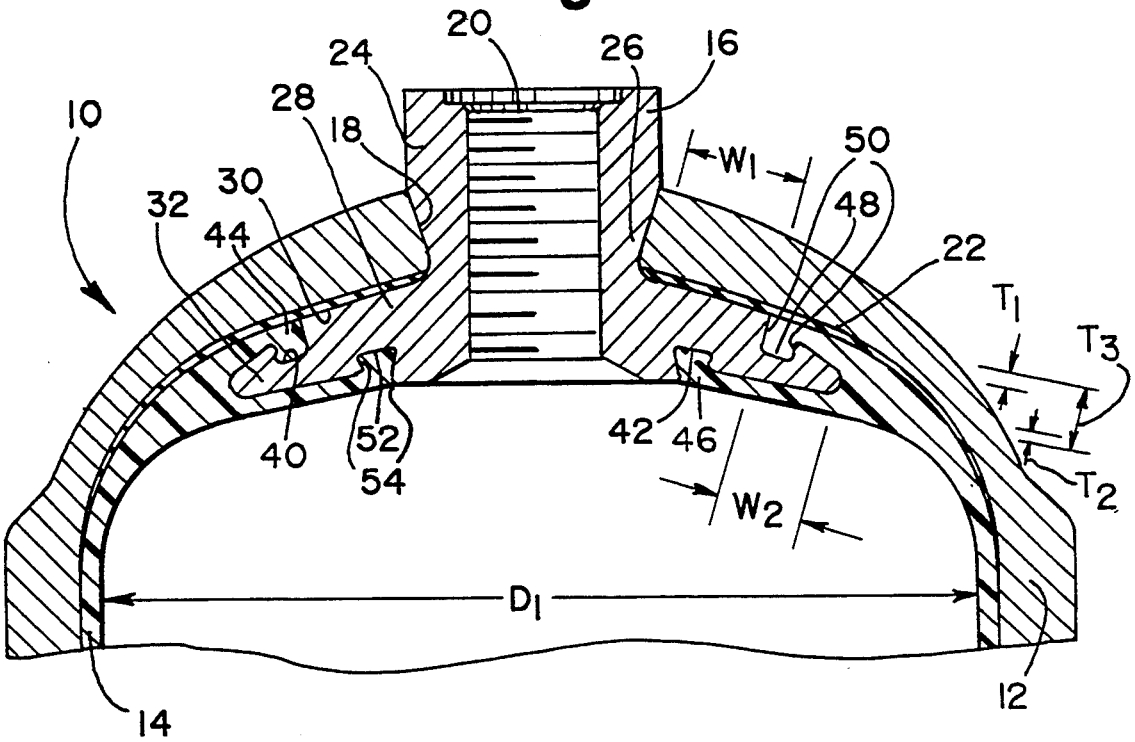
FIG. 1 is fragmentary sectional view of the rounded end of an axisymmetric pressure vessel having a boss which incorporates the features of the present invention.

FIG. 1 illustrates in fragmented section the rounded, preferably substantially spherical, end of an axisymmetric pressure vessel, generally designated 10. The pressure vessel 10 is comprised of a fiber reinforced outer shell 12 and a non-metallic internal liner 14. A boss 16 according to the present invention extends outwardly through a polar opening 18 formed in the outer shell 12 and defines a pressurization port 20 through which fluid at high pressure may be communicated with the interior of the pressure vessel 10. It is to be noted, however, that the invention may be used in connection with non-polar openings in vessels, as, for example, an opening in a purely spherical vessel. A thin shear accommodating layer 22 is interposed between the outer shell 12, the boss 16 and the liner 14 to prevent damage to the shell or liner during pressurization of the vessel, as will be described hereafter.

The outer shell 12 comprises a generally known composite reinforcement made of fiber reinforcing material in a resin matrix. The fiber may be fiberglass, ARAMID, carbon, graphite, or any other generally known fibrous reinforcing material. The resin matrix used may be epoxy, polyester, vinylester, thermoplastic or any other suitable resinous material capable of providing the fragmentation resistance required for the particular application in which the vessel is to be used.

The internal liner 14 may be made of plastic or other elastomers and can be manufactured by compression molding, blow molding, injection molding or any other generally known technique. The boss 16 preferably is composed of an alloy of aluminum, steel, nickel, or titanium, although it is understood that other metal and non-metal materials, such as composite materials, are suitable. The thin layer 22 may be made of plastic, or other non-metallic material and may be manufactured by a molding process or, alternatively, cut from sheet stock.

As shown in FIG. 1, the subject boss 16 has an outwardly projecting neck 24 with a tapered throat 26 extending through the polar opening 18 in the outer shell 12. The throat 26 is tapered so as to form a concave peripheral groove for receipt of the fiber and resin matrix which make up the shell so that the latter captures the boss 16 to prevent movement of the boss into or out of the vessel 10.

Immediately within the pressure vessel 10, an annular support flange 28 radiates from the neck 24 and defines an outer surface 30 of the support flange 28 by which pressurization loads are distributed about the perimeter of the polar opening 18 in the composite shell 12. The support flange 28 has a width $W_1$ such that the overall diameter of the support flange 28 is sufficient to prevent damage to the outer shell 12 when the pressure vessel 10 is pressurized.

In addition, a portion of the thin layer 22 is interposed between the support flange 28, the liner 14 and the outer shell 12 to further minimize damage as the vessel is pressurized. Specifically, pressurization of the vessel interior results in expansive distortion of the rounded vessel end, such that relative slip between the inner surface of the outer shell 12 and the mating portions of the liner 14 and the support flange 28 may occur. In order to accommodate the relative slip and relieve shear stresses otherwise occurring at this interface, the interposed layer 22 extends across the rounded vessel end a distance substantially equal to the diameter $D_1$ of the circular section of the pressure vessel 10.

An annular attachment flange 32 projects radially outward from the support flange 28 a distance $W_2$. The attachment flange 32 has an outer surface 34 which is inwardly offset from the outer surface 30 of the support flange 28 by a distance $T_1$, and the attachment 32 has an inner surface 36 which is outwardly offset from an inner surface 38 of the support flange 28 by a distance $T_2$. Thus, support flange 28 has a thickness $T_3$ which is sufficient to limit bending stresses in the boss to an acceptable level when the vessel is pressurized.

A pair of annular locking grooves 40 and 42, respectively, are located one in outer surface 34 of the attachment flange 32 and the other in the inner surface 36 of the support flange 38. Each groove receives a complementary tab 44,46, respectively, on the internal liner 12.

The locking groove 40 is an outwardly opening groove having a bottom wall 48 intermediate a pair of mutually skewed sidewalls 50, which is to say the groove 40 is a dove-tailed groove. It is understood that other undercut features effective to mechanically lock the liner to the boss are contemplated by the present invention.

The locking groove 42 is formed in the inner surface 36 of the attachment flange 32 and has a bottom wall 52 intermediate a pair of mutually skewed sidewalls 54 to again define a dove-tail groove. The complementary geometry of the skewed sidewalls 50 and 54 and respective liner tabs 44 and 46 ensure positive engagement and retention of the internal liner 14 on the boss 16 such that pressurized fluid is prevented from leaking between the liner and the outer shell 12.

The offset characteristic of the attachment flange 32 as defined by the inward offset $T_1$ of the outer surface 34 and the outward offset $T_2$ of the inner surface 36 reduces the risk that the liner 14 will extrude out of engagement with the boss 16 when under pressure by providing a sufficient surface area for the liner to seal with the attachment flange and prevent leakage.

Figure 2:
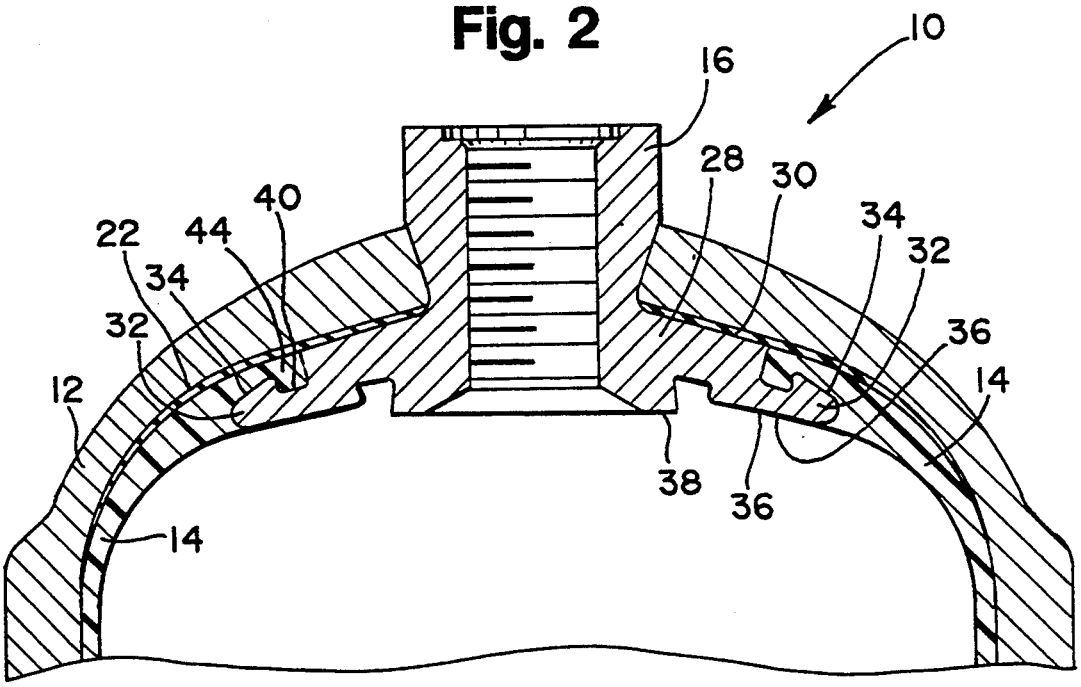
FIG. 2 is a fragmentary sectional view similar to FIG. 1 in which the boss is joined to the pressure vessel along only one side thereof, and wherein the internal liner engages only one of the locking grooves in the radial flange.

FIG. 2 illustrates an alternative embodiment of the invention in which the internal liner 14 only engages the annular locking groove 40 formed in the outer surface 34 of the attachment flange 32. In the embodiment illustrated in FIG. 2, the internal liner 14 has only a singular annular tab 44 engaged with the boss 16.

Figure 3:
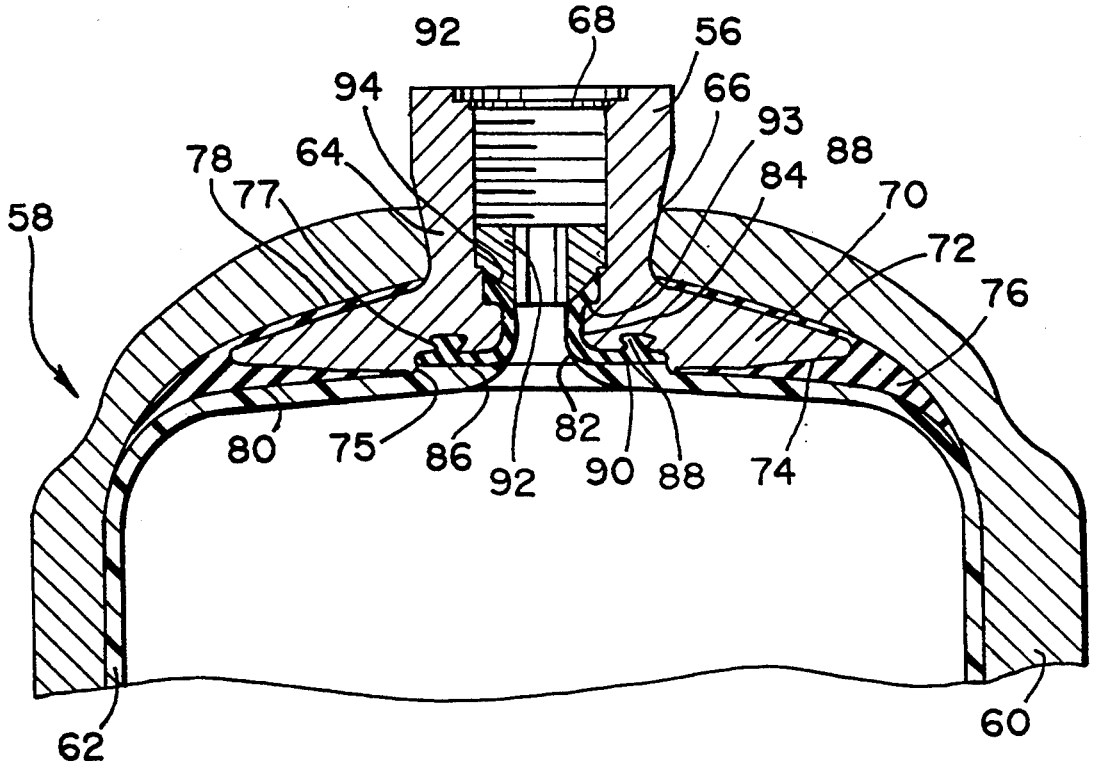
FIG. 3 is fragmentary sectional view of the rounded end of an axisymmetric pressure vessel having a further embodiment of a boss construction.

FIG. 3 illustrates a further embodiment of a boss 56 used in conjunction with a filament wound pressure vessel, generally designated 58. Pressure vessel 58 has a fiber reinforced outer shell 60 and a non-metallic internal liner 62. In a preferred form, the internal liner is formed of blow molded high density polyethylene (HDPE). Boss 56 has a tubular neck 64 which extends axially outward through a polar opening 66 formed in the outer shell 60 and defines a stepped pressurization port 68 through which fluid at high pressure may be communicated with the interior of pressure vessel 58.

An annular support flange 70 radiates outwardly from neck 64 immediately within the pressure vessel and has a sloped outer surface 72 and an oppositely sloped inner surface 74. In other words, surfaces 72 and 74 converge toward the periphery of flange 70. Outer surface 72 distributes pressurization loads about the perimeter of the polar opening 66 in the composite shell 60 to prevent damage to the outer shell when pressure vessel 58 is pressurized. Inner surface 74 has a recessed portion 75 adjacent pressurization port 68 and an axially inward opening groove 77 for purposes to be described hereafter.

A thin shear accommodating layer 76 is interposed between outer shell 60, boss 56 and internal liner 62 to prevent damage to the shell or liner during pressurization of the vessel. More specifically, shear accommodating layer 76 has a pair of divergent leaves 78 and 80. Leaf 78 is interposed between outer surface 72 of support flange 70 and the inner surface of outer shell 60, and leaf 80 is interposed between inner surface 74 of support flange 70 and the outer side of internal liner 62. Shear accommodating layer 76 preferably is formed of a material suitable for relieving slip-induced shear stresses otherwise occurring at the interface of support flange 70, internal liner 62, and outer shell 60 when vessel 58 is pressurized. Injection molded thermoplastic elastomers, such as thermoplastic rubber, have been found to provide suitable performance characteristics in a shear accommodating layer.

Internal liner 62 is attached to boss 56 by means of an axisymmetric interface member 82. The interface member preferably is formed of injection molded high density polyethylene (HDPE) which, when cooled, shrinks into conformity with boss 56 as shown in FIG. 3. More specifically, the HDPE solidifies to form an elongated hub 84 disposed in pressurization port 68 and a radially extending collar 86 seated in the recessed portion 75 of inner surface 74 on support flange 70. The HDPE flows into groove 77 and thereby forms a complementary tab 88 for inter-locking the interface member and polar boss 56. In applications where it is desired to more securely bond interface member 82 to the polar boss, an adhesive coating is applied to the boss prior to injection of the HDPE. Once interface member 82 is firmly secured to boss 56, liner 62 is bonded to the interface member along a common seam 90. Conventional plastic welding techniques, such as hot plate welding, are effective to reliably bond the HDPE liner 62 and interface member 82.

Securement of interface member 82 is enhanced by a threaded retainer nut 92 which is advanced through pressurization port 68 in the boss to lock a distal end of elongated hub 84 against the stepped inner side wall 93 of neck 64. An O-ring seal 94 is captured between retainer nut 92 and interface member 82.

The boss construction illustrated in FIG. 3 advantageously reduces the risk of leakage from liner 62 by moving the principal leakage path, that is the junction at which the distal end of hub 84 on interface member 82 meets boss 56, into the neck of the pressure vessel and upstream of retainer nut 92. Consequently, the junction is not subjected to the pressure contained within the vessel and the likelihood of leakage thereby is reduced. In addition, the embodiment of FIG. 3 isolates boss 56 from fluids contained within vessel 58 and thus prevents 1) contamination of the fluid contents of the pressure vessel, and 2) corrosion of the boss.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A boss system for a pressure vessel having a filament wound outer shell and a non-metallic internal liner, the system comprising:

a boss having a tubular neck projecting outwardly through an opening in the outer shell;

an annular flange extending radially from an end of the neck within the vessel, the annular flange having an outer surface for reinforcing the perimeter of the opening in the shell;

a first generally dovetail-shaped locking groove in the outer surface of the annular flange;

a second generally dovetail-shaped locking groove in the inner surface of the annular flange;

the liner being split at the annular flange with an outside portion outside the flange and an inside portion inside the flange;

a first generally dovetail-shaped tab on the outside portion of the liner for locking in the first locking groove in the outside surface of the annular flange; and a second generally dovetail-shaped tab on the inside portion of the liner for locking in the second lockings groove in the inside surface of the annular flange.

2. The boss system of claim 1 in which the boss comprises a material selected from the group consisting of alloys of aluminum, steel, nickel, and titanium or of composite materials.

3. A boss system for a pressure vessel having a filament wound outer shell and a non-metallic internal liner, the system comprising:

a boss having a tubular neck projecting outwardly through an opening in the outer shell;

an annular support flange extending radially from an end of the neck within the vessel, the annular flange having an outer surface for reinforcing the perimeter of the opening in the shell and an inner surface opposite the outer surface;

an attachment flange extending radially from the support flange and having an outer surface spaced inwardly of the outer shell;

a first generally dovetail-shaped locking groove in the outer surface of the attachment flange;

a second generally dovetail-shaped locking groove in the inner surface of the annular support flange;

the liner being split at the attachment flange with an outside portion outside the attachment flange and an inside portion inside the attachment flange and the support flange;

a first generally dovetail-shaped tab on the outside portion of the liner for locking in the first locking groove in the outside surface of the attachment flange; and a second generally dovetail-shaped flange on the inside portion of the liner for locking in the second locking groove in the inside surface of the annular support flange.

4. A boss for a pressure vessel having a filament wound outer shell and a non-metallic internal liner, the shell having a circular section and defining a rounded vessel end, the boss comprising:

a tubular neck projecting outwardly through an opening in the rounded vessel end;

an annular flange extending radially from an end of the neck within the vessel, the annular flange having an outer surface for reinforcing the perimeter of the opening in the rounded vessel end; and a shear stress relieving layer at said rounded end and interposed between the inner surface of the outer shell and the internal liner to accommodate relative slip therebetween during pressurization of the vessel.

5. The boss of claim 4 in which the shear stress relieving layer extends across said rounded vessel end a distance substantially equal to the diameter of the shell circular section.

6. The boss of claim 4 in which the shear stress relieving layer is non-metallic layer.

7. The boss of claim 4 in which the shear stress relieving layer is made of plastic.

8. The boss of claim 4 including a locking groove in the annular flange engaged with a complementary tab on the liner.

9. The boss of claim 4 wherein said shear stress relieving layer also abuts said outer surface to be additionally interposed between said inner and outer surfaces.

10. A pressure vessel comprising:

a filament wound outer shell;

a non-metallic internal liner disposed within the shell;

a boss having a tubular neck projecting outwardly through an opening in the outer shell and an annular flange extending radially from an end of the neck within the vessel, the annular flange having an outer surface for reinforcing the perimeter of the opening the shell;

complementary inter-engaging locking means between the annular flange and the liner; and a shear stress relieving layer interposed between an outer surface of the annular flange and an inner surface of the outer shell to accommodate relative slip therebetween during pressurization of the vessel.

11. The pressure vessel system of claim 10 in which the shear stress relieving layer is made of a thermosetting elastomer.

12. A boss for a pressure vessel having a filament wound outer shell and a non-metallic internal liner, the boss comprising:

a tubular neck projecting axially through an opening in the outer shell;

an annular flange extending radially from the neck within the vessel, the annular flange having an outer surface for reinforcing the perimeter of the opening in the shell and an inner surface for mounting the liner;

an interface member interposed between the liner and the inner surface of the annular flange and defining a site for attachment of the liner; and means for securing the interface member to at least one of the annular flange and the neck.

13. The boss of claim 12 in which the liner comprises a blow molded component.

14. The boss of claim 12 in which the liner is made of high density polyethylene.

15. The boss of claim 12 in which the interface member comprises an injection molded component.

16. The boss of claim 12 in which the interface member is made of high density polyethylene.

17. The boss of claim 12 in which the means for securing the interface member comprises complementary inter-engaging locking means between the annular flange and the interface member.

18. The boss of claim 17 in which said complementary inter-engaging locking means comprise a locking groove in one of the annular flange and interface member engaged with a complementary tab on the other of the annular flange and interface member.

19. The boss of claim 12 in which the means for securing the interface member comprises a coupling interconnected between the neck and the interface member.

20. The boss of claim 12, including a shear stress relieving layer interposed between said flange outer surface and said shell to accommodate relative slip therebetween during pressurization of the vessel.

21. The boss of claim 12, including a shear stress relieving layer interposed between said flange inner surface and the liner to accommodate relative slip therebetween during pressurization of the vessel.

22. A boss for a pressure vessel having a filament wound outer shell and a non-metallic internal liner, the boss comprising:

a tubular neck projecting axially through an opening in the outer shell, said neck defining a pressurization port through which fluid is communicated with the vessel interior;

an annular flange extending radially from the neck within the vessel, the annular flange having a sloped outer surface for reinforcing the perimeter of the opening in the shell and an inner surface sloped oppositely said outer surface for mounting the liner;

interface means for connecting the liner to the annular flange; and a unitary shear stress relieving member having a first layer interposed between said flange outer surface and said shell and a second layer interposed between said flange inner surface and the liner to accommodate relative slip therebetween during pressurization of the vessel.

23. A boss for a pressure vessel having a filament wound outer shell and a non-metallic internal liner, the boss comprising:

a tubular neck projecting outwardly through an opening in the outer shell;

an annular flange extending radially from an end of the neck within the vessel, the annular flange having an outer surface for reinforcing the perimeter of the opening in the shell;

a locking groove in the annular flange engaged with a complementary tab on the liner; and a shear stress relieving layer interposed between the outer surface of the annular flange and the inner surface of the outer shell to accommodate relative slip therebetween during pressurization of the vessel.

* * * * *